United States Patent [19]

Hartwell et al.

[11] Patent Number: 4,912,764

[45] Date of Patent: Mar. 27, 1990

[54] DIGITAL SPEECH CODER WITH DIFFERENT EXCITATION TYPES

[75] Inventors: Walter T. Hartwell, St. Charles; Joseph Picone, Forest Park; Dimitrios P. Prezas, Park Ridge, all of Ill.

[73] Assignee: American Telephone and Telegraph Company, AT&T Bell Laboratories, both of Murray Hill, N.J.

[21] Appl. No.: 770,632

[22] Filed: Aug. 28, 1985

[51] Int. Cl.[4] ..... G10L 7/02

[52] U.S. Cl. ..... 381/38

[58] Field of Search ..... 381/36–41, 381/49, 29–35, 51–53; 364/513.5

[56] References Cited

U.S. PATENT DOCUMENTS

| | | | |
|---|---|---|---|
| 3,852,535 | 12/1974 | Zurcher | 179/1 SA |
| 3,903,366 | 9/1975 | Coulter | 179/1 SA |
| 3,916,105 | 10/1975 | McCray | 179/1.5 D |
| 3,979,557 | 9/1976 | Schulman et al. | 179/1 SA |
| 4,058,676 | 11/1977 | Wilkes et al. | 179/1 SA |
| 4,301,329 | 11/1981 | Taguchi | 179/1 SA |
| 4,360,708 | 11/1982 | Taguchi et al. | 179/15.55 R |
| 4,472,832 | 9/1984 | Atal et al. | 381/40 |
| 4,561,102 | 12/1985 | Prezas | 381/49 |
| 4,618,982 | 10/1986 | Horvath et al. | 381/36 |
| 4,669,120 | 5/1987 | Ono | 381/40 |
| 4,696,038 | 9/1987 | Doddington et al. | 381/38 |
| 4,701,954 | 10/1987 | Atal | 381/49 |
| 4,709,390 | 11/1987 | Atal et al. | 381/38 |

OTHER PUBLICATIONS

Makhoul et al., "A Mixed-Source Model for Speech Compression and Synthesis", J. Acoust. Soc. America, vol. 64, No. 6, 12/78, pp. 1577–1581.

Araseki et al., "Multi-Pulse Excited Speech Coder Based on Maximum Crosscorrelation Search Algorithm", Global Telecom., Con., 1983, pp. 23.3.1–23.3.5.

S. Holm, "Automatic Generation of Mixed Excitation in a Linear Predictive Speech Synthesizer", Proc. Int. Conf. Acoust., Speech and Sign. Process., Atlanta, 118–120, 1981.

M. Copperi et al., "Vector Quantization and Perceptual Criteria for Low-Rate Coding of Speech", Proc. Int. Conf. Acoust., Speech and Sign. Process., Tampa, 252–255, 1985.

J. D. Markel et al., "A Linear Prediction Vocoder Simulation Based Upon the Autocorrelation Method", Trans. on Acoust., Speech and Sign. Process., 124–134, 1974.

M. L. Malpass, "The Gold-Rabiner Pitch Detector in a Real Time Environment", Electronics and Aerospace Syst. Conv., Washington, 31.A–13.G.

C. K. Un et al., "A Pitch Extraction Algorithm Based on LPC Inverse Filtering and AMDF", Trans. on Acoust., Speech and Sign. Process., 565–572, 1977.

C. K. Un et al., "A 4800 BPS LPC Vocoder with Improved Excitation", Int. Conf. Acoust., Speech and Sign. Process., Denver, 142–154, 1980.

D. Y. Wong, "On Understanding the Quality Problems of LPC Speech", Int. Conf. Acoust., Speech and Sign. Process., Denver, 725–728, 1980.

(List continued on next page.)

*Primary Examiner*—David L. Clark
*Assistant Examiner*—John A. Merecki
*Attorney, Agent, or Firm*—John C. Moran

[57] ABSTRACT

An speech analysis and synthesis system where pitch information for excitation is transmitted during voiced segments of speech and modified residual information for excitation is transmitted during unvoiced speech segments along with linear predictive coded (LPC) parameters. The speech analysis portion of the system uses a pitch detection circuit to determine when the speech is voiced or unvoiced and to calculate the pitch information during voiced segments. A multi-pulse excitation forming circuit generates the modified residual signal which is obtained from the cross correlation of the residual signal and the LPC-recreated original signal. The pitch detection circuit controls a multiplexer which selects either the output of the multi-pulse excitation forming circuit or the output of the pitch detection circuit for transmission as the excitation information with LPC parameters to the synthesizer portion of the system.

10 Claims, 3 Drawing Sheets

OTHER PUBLICATIONS

S. T. Alexander, "A Simple Noniterative Speech Excitation Algorithm Using the LPC Residual", Trans. on Acoust., Speech and Sign. Process., 432–434, 1985.

"Improving Performance of Multipulse LPC Coders at Low Bit Rates", B. Atal and S. Singhal, *ICASSP* '84, pp. 1.3–1.4.

"A New Model of LPC Excitation for Producing Natural-Sounding Speech at Low Bit Rates", B. Atal and J. Remde, *ICASSP* '82, pp. 614–617.

"An Integrated Pitch Tracking Algorithm for Speech Systems", B. G. Secrest and G. R. Doddington, in *Proc. 1983, Int. Conf. Acoust., Speech, Signal Processing,* pp. 1352–1355, Apr. 1983.

"Postprocessing Techniques for Voice Pitch Trackers", B. G. Secrest and G. R. Doddington, in Proc. 1982, *IEEE Int. Conf. Acoust., Speech, Signal Processing,* pp. 172–175, Apr. 1982.

"A Procedure for Using Pattern Classification Techniques to Obtain a Voiced/Unvoiced Classifier", L. J. Siegel, *IEEE Transactions on Acoustics, Speech, and Signal Processing,* vol. ASSP-27, No. 1, pp. 83–89, Feb. 1979.

"Parallel Processing Techniques for Estimating Pitch Periods of Speech in the Time Domain", B. Gold and L. R. Rabiner, *The Journal of the Acoustical Society of America,* vol. 46, No. 2, pp. 442–448, 1969.

DIGITAL SPEECH CODER WITH DIFFERENT EXCITATION TYPES

CROSS-REFERENCE TO RELATED APPLICATIONS

Concurrently filed herewith and assigned to the same assignee as this application are: J. Picone, et al., "A Parallel Processing Pitch Detector", Ser. No. 770,633; and D. Prezas, et al., "Voice Synthesis Utilizing Multi-Level Filter Excitation", Ser. No. 770,631.

TECHNICAL FIELD

Our invention relates to speech processing and more particularly to digital speech coding arrangements directed to the excitation of a speech synthesizer.

BACKGROUND OF THE INVENTION

Digital speech communication systems including voice storage and voice response facilities utilize signal compression to reduce the bit rate needed for storage and/or transmission. One well-known digital speech coding system, such as disclosed in U.S. Pat. No. 3,624,302, issued Nov. 30, 1971, includes linear prediction analysis of an input speech signal. The speech signal is partioned into successive intervals and a set of parameters representative of an interval of speech is generated. The parameter set includes linear prediction coefficient signals representative of the spectral envelope of the speech in the interval, and the pitch and voicing signal corresponding to the speech excitation. These parameter signals may be encoded at a much lower bit rate than the speech signal wave form itself. A replica of the input speech signal is formed from the parameter signal codes by synthesis. The synthesizer arrangement generally comprises a model of the vocal tract in which the excitation pulses are modified by the spectral envelope representative prediction coefficients in an all pole predictive filter. Whereas this type of pitch excited linear predictive coding is very efficient, the produced speech replica exhibits a synthetic quality that is often difficult to understand.

Another known digital speech coding system is disclosed in U.S. Pat. No. 4,472,832, issued Sept. 18, 1984. In this analysis and synthesis system, LPC parameters and a modified residual signal for excitation are transmitted. The excitation signal is a sequence of pulses selected from the peaks of the cross-correlation of the LPC filter impulse response and the original signal. This type of excitation is often referred to in the art as multi-pulse excitation. Whereas this system produces a good speech replica, it is limited to minimum bit rates of approximately 9.6 kilobits per second (Kbs). In addition, during the voiced regions, the speech replica tends to have a detectable roughness. Also, the method requires a large number of complex calculations.

In view of the foregoing, there exists a need for an analysis and synthesis system that is capable of producing an accurate speech replica during the voiced period of a speech wave and also during the unvoiced regions of the speech wave. In addition, it is desirable to have a lower bit rate.

SUMMARY OF THE INVENTION

The aforementioned problems are solved and a technical advance is achieved in accordance with the principles of this invention incorporated in an illustrative method and an analysis and synthesis system that allows the utilization of pitch excitation during the voice portions of speech and the utilization of other than noise excitation during the unvoiced portions of the speech.

The illustrative method for encoding speech comprises the steps of partitioning the speech into successive time frames, generating for each frame a set of speech parameters signals that define the vocal tract, generating a voiced signal for each of said speech frames comprising voiced speech, generating an unvoiced signal for each of said speech frames comprising unvoiced speech, producing a coded excitation signal comprising pitch type excitation information for each of the speech frames indicated to be voiced by the voiced signal and other than noise excitation information for each of the speech frames designated as unvoiced by the unvoiced signal, and combining the resulting coded excitation signal and the speech parameter signals for each of the frames to form a coded combined signal representative of the speech.

Advantageously, the other than noise type excitation information is a sequence of pulses selected from peaks of the cross-correlation of the impulse response of the set of parameter signals and the original speech for each of the frames. Also, the step of generating the parameter signal set consists of generating linear predictive coefficients that model the vocal tract.

Also the partitioning step consists of forming speech samples of the speech pattern for each of the frames and generating residual samples for the speech pattern for each frame. The step of producing the pitch type excitation information comprises the steps of estimating a first and second pitch value for positive and negative ones of the speech samples of each frame, respectively, estimating a third and fourth pitch value in response to positive and negative residual samples, respectively, and determining a final pitch value of a last previous speech frame in response to the estimated pitch values for the last previous speech frame and pitch values for a plurality of previous speech frames and the present speech frame.

In addition, the step of determining the pitch value comprises the steps of calculating a pitch value from the estimated pitch values and constraining the final pitch value so that the calculated pitch value is in agreement with the calculated pitch values from previous frames.

Advantageously, the method comprises the following steps for producing a replica of the original speech: detecting whether the excitation is pulse or pitch type excitation, modeling said vocal tract in response to the LPC parameters, and generating excitation to drive the model utilizing pitch type excitation upon the latter being detected or generating pulse type excitation in response to the latter being detected.

The illustrative analysis and synthesis system comprises a unit for quantizing, digitizing, and storing the speech as a plurality of speech frames each having a predetermined number of samples. Another unit is responsive to the samples of each frame to calculate a set of speech parameters that model the vocal tract. A detection unit generates a signal indicating whether each frame is voiced or unvoiced, and an excitation unit is responsive to the signal from the detection unit to produce excitation information having pitch type excitation information if the frame is designated as voiced or other than noise type excitation information if the frame is designated as unvoiced. Finally, a channel encoder unit is used to combine the excitation information and the set of speech parameters for transmission to a synthesizer subsystem.

The excitation unit generates the other than noise type excitation information by performing a cross-correlation operation of the impulse response of the set of parameter signals which, advantageously, may be linear predictive parameters, and the speech for each frame to produce pulse signals representing the cross-correlation. In addition, the excitation unit selects a sequence of pulses from the cross-correlated pulses to be the other than noise type excitation.

The synthesis unit is responsive to the excitation information and the set of speech parameters to produce a replica of the original speech by forming a synthesizer filter and driving this filter with pitch excitation information if the received information is voiced, or other than noise type excitation information if the received information is unvoiced.

DETAILED DESCRIPTION

Figure 1:
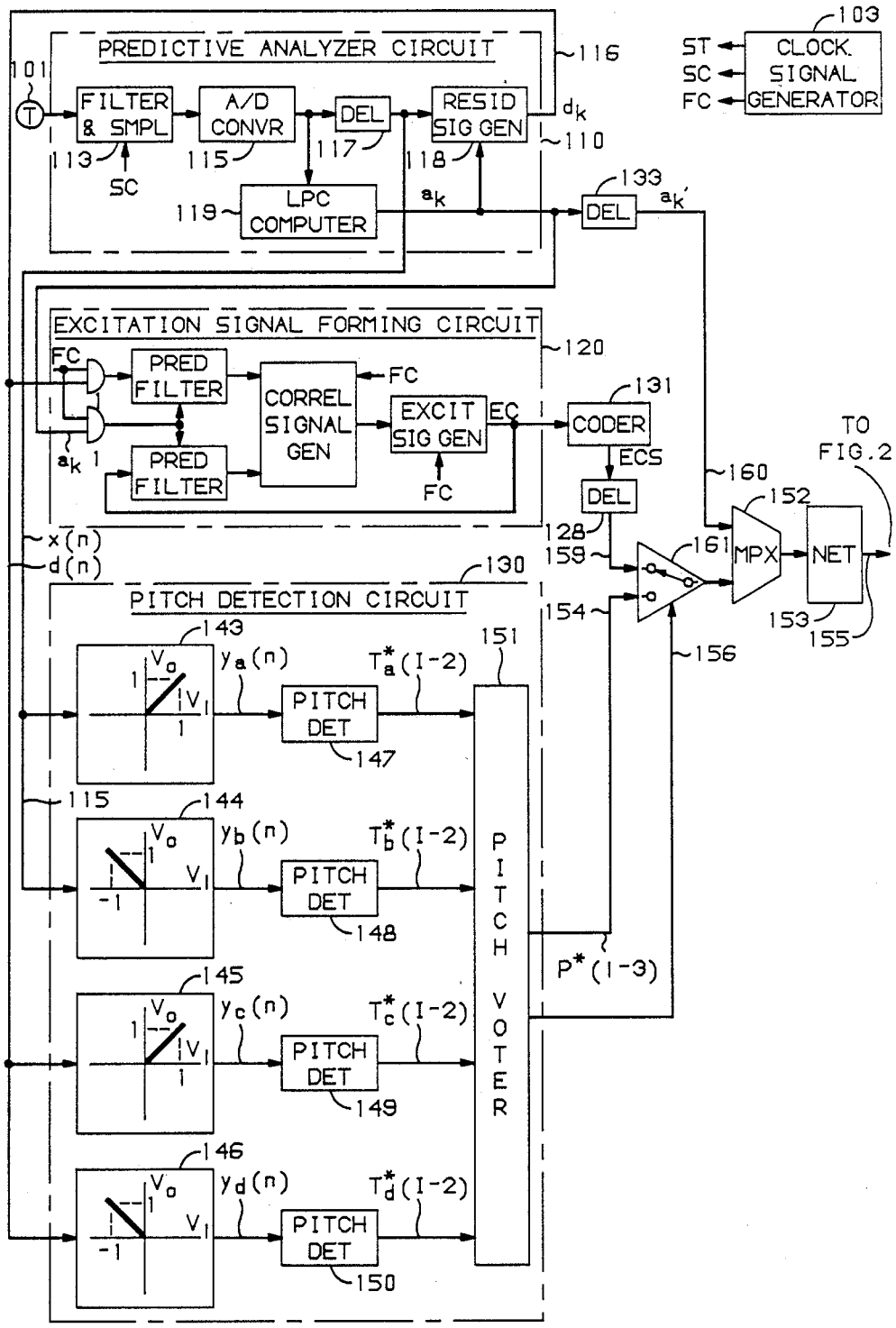
FIG. 1 illustrates, in block diagram form, an analyzer in accordance with this invention.

FIG. 1 illustrates, in block diagram form, a speech analyzer in which a speech pattern such as a spoken message is received by microphone transducer 101. The corresponding analog speech signal is band limited and converted into a sequence of pulse samples in filter and sampler circuit 113 of prediction analyzer 110. The filtering may be arranged to remove frequency components of the speech signal above 4.0 kilohertz (Khz) and the sampling may be at 8.0 Khz rate as is well known in the art. The timing of the samples is controlled by sample clock SC from clock generator 103. Each sample from circuit 113 is transformed into an amplitude representative digital code in analog-to-digital converter 1165.

The sequence of speech samples is supplied to predictive parameter computer 119 which is operative, as is well known in the art, to partition the speech signals into 10 to 20 milliseconds intervals and to generate a set of linear prediction coefficient signals $a_k$, $k=1, 2, \ldots, p$ representative of the predicted short-time spectrum of the $N>p$ speech samples of each interval. The speech samples from A/D converter 115 are delayed in delay 117 to allow time for the formation of the signals $a_k$. The delayed samples are supplied to the input of prediction residual generator 118. The prediction residual generator, as is well known in the art, is responsive to the delayed speech samples and the prediction parameters $a_k$ to form a signal corresponding to the LPC prediction error. The formation of the predictive paramenters and the prediction residual signal in predictive analyzer 110 may be performed according to the arrangement disclosed in U.S. Pat. No. 3,740,476, issued to B. S. Atal, June 19, 1973, and assigned to the same assignee as this application or in any other arrangements well known in the art.

The prediction residual signals $d_k$ and the predictive parameter signals $a_k$ for each successive frame are applied from circuit 110 to excitation signal forming circuit 120 at the beginning of the succeeding frame. Circuit 120 is operative to produce a multi-element frame excitation code EC, also referred to as a multi-pulse code or modified residual code, having a predetermined number of bit positions for each frame. Each excitation code corresponds to a sequence of $1 \leqq i \leqq I$ pulses representative of the excitation function of the frame. The amplitude $M_i$ and location $D_i$ of each pulse within the frame is determined in the excitation signal forming circuit so as to permit construction of a replica of the frame speech signal from the excitation signal and the predictive parameter signals of the frame. The $D_i$ and $M_i$ signals are encoded in coder 131 and transferred via path 159 to selector 161. The formation of the excitation code EC, $D_i$ and $M_i$ signals by circuit 120 may be performed according to the arrangement disclosed in U.S. Pat. No. 4,472,832, issued to B. S. Atal, et al., Sept. 18, 1984, and assigned to the same assignee as this application or in any other arrangements well known in the art. The delays 133 and 128 time align the outputs of 110, 120, and 130 such that each presents coincidental data to the multiplexer 152 which is derived from the same speech segment.

In response to the digital speech samples and the residual samples, pitch detection circuit 130 is responsive to those signals to determine whether or not a speech frame is voiced or unvoiced. If the determination is made that the speech frame is unvoiced, pitch detection circuit transmits via path 156 an unvoiced signal to data selector 161. This causes data selector 161 to select the amplitude and location information, $D_i$ and $M_i$ from coder 131 for communication to multiplexer. The latter multiplexer is responsive to the information from delay 128 and the parameter information from delay 133 received via path 160 to encode this information for transmission via network 153 to the synthesizer of FIG. 2. If the determination is made by detection circuit 130 that the frame is voiced, then the signal transmitted via 156 causes selector 161 to select the pitch information for that frame transmitted via path 154 from detection circuit 130 to be communicated to multiplexer 152. Multiplexer 152 is responsive to the pitch information and the parameter information to encode this information for transmission to the synthesizer of FIG. 2 via network 153.

Figure 2:
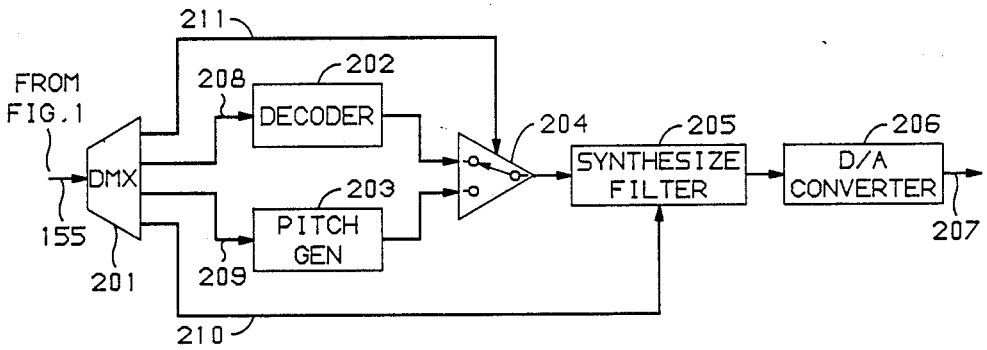
FIG. 2 illustrates, in block diagram form, a synthesizer in accordance with this invention.

The synthesizer is illustrated in FIG. 2. Demultiplexer 201 is responsive to information received from network 153 via path 155 to determine whether the excitation should be multi-pulse or pitch. If the excitation should be pitch, then the pitch information is transferred to pitch generator 203 via path 209. In addition, the multiplexer causes selector 204 to select the output of pitch generator 203 so that this output can be an input to synthesis filter 205. Also, demultiplexer 201 inputs to synthesis filter 205 the linear predictive coding parameters to properly set the filter. Synthesis filter 205 is responsive to the excitation received from selector 204 and the LPC coefficients to reproduce a replica of the original speech in digital form. Digital-to-analog converter 206 is responsive to these digital samples to produce a corresponding analog signal on conductor 207.

If demultiplexer 201 receives information from network 153, indicating that the excitation is pulse excitation, then it transfers the amplitude and location information to decoder 202 via path 208 and causes selector 204 via path 211 to select the output of decoder 202 for communication to synthesize filter 205. In addition, demultiplexer 201 transmits the LPC coefficients to synthesize filter 205, and synthesizer filter 205 and digital-to-analog converter 206 function as previously described.

Now, consider pitch detection circuit 130 of FIG. 1 in greater detail. The clippers 143 through 146 transform the incoming x and d digitized signals on paths 115 and 116, respectively, into positive-going and negative-going waveforms. The purpose for forming these signals is that whereas the composite waveform might not clearly indicate periodicity the clipped signal might. Hence, the periodicity is easier to detect. Clippers 143 and 145 transform the x and d signals, respectively, into positive-going signals and clippers 144 and 146 transform the x and d signals, respectively, into negative-going signals.

Pitch detectors 147 through 150 are each responsive to their own individual input signals to make a determination of the periodicity of the incoming signal. The output of the pitch detectors is two frames after receipt of those signals. Note, that each frame consists of, illustratively, 160 sample points. Pitch voter 151 is responsive to the output of the four pitch detectors to make a determination of the final pitch. The output of pitch voter 151 is transmitted via path 154.

Figure 3:
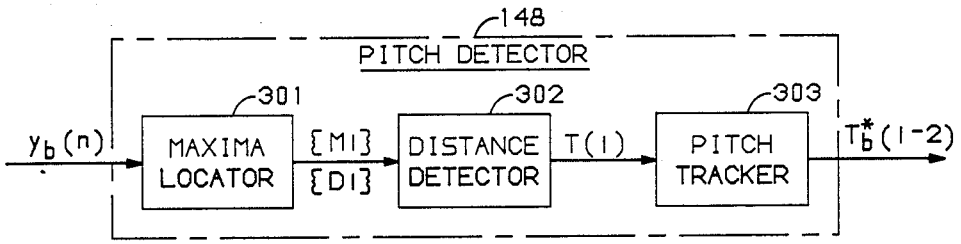
FIG. 3 illustrates, in block diagram form, pitch detector 148 of FIG. 1.

FIG. 3 illustrates in block diagram form, pitch detector 148. The other pitch detectors are similar in design. The maxima locator 301 is responsive to the digitized signals of each frame for finding the pulses on which the periodicity check is performed. The output of maxima locator 301 is two sets of numbers: those representing the maximum amplitudes, $M_i$, which are the candidate samples, and those representing the location within the frame of these amplitudes, $D_i$. Distance detector 302 is responsive to these two sets of numbers to determine a subset of candidate pulses that are periodic. This subset represents distance detector 302's determination of what the periodicity is for this frame. The output of distance detector 302 is transferred to pitch tracker 303. The purpose of pitch tracker 303 is to constrain the pitch detector's determination of the pitch between successive frames of digitized signals. In order to perform this function, pitch tracker 303 uses the pitch as determined for the two previous frames.

Consider now in greater detail, the operations performed by maxima locator 301. Maxima locator 301 first identifies within the samples from the frame, the global maxima amplitude, $M_0$, and its location, $D_0$, in the frame. The other points selected for the periodicity check must satisfy all of the following conditions. First, the pulses must be a local maxima, which means that the next pulse picked must be the maximum amplitude in the frame excluding all pulses that have already been picked or eliminated. This condition is applied since it is assumed that pitch pulses usually have higher amplitudes than other samples in a frame. Second, the amplitude of the pulse selected must be greater than or equal to a certain percentage of the global maximum, $Mi > gM_0$, where g is a threshold amplitude percentage that, advantageously, may be 25%. Third, the pulse must be advantageously separated by at least 18 samples from all the pulses that have already been located. This condition is based on the assumption that the highest pitch encountered in human speech is approximately 444 Hz which at a sample rate of 8 kHz results in 18 samples.

Distance detector 302 operates in a recursive-type procedure that begins by considering the distance from the frame global maximum, $M_0$, to the closest adjacent candidate pulse. This distance is called a candidate distance, $d_c$, and is given by $$d_c = |D_0 - D_i|$$

where $D_i$ is the in-frame location of the closest adjacent candidate pulse. If such a subset of pulses in the frame are not separated by this distance, plus or minus a breathing space, B, then this candidate distance is discarded, and the process begins again with the next closest adjacent candidate pulse using a new candidate distance. Advantageously, B may have a value of 4 to 7. This new candidate distance is the distance to the next adjacent pulse to the global maximum pulse.

Figure 4:
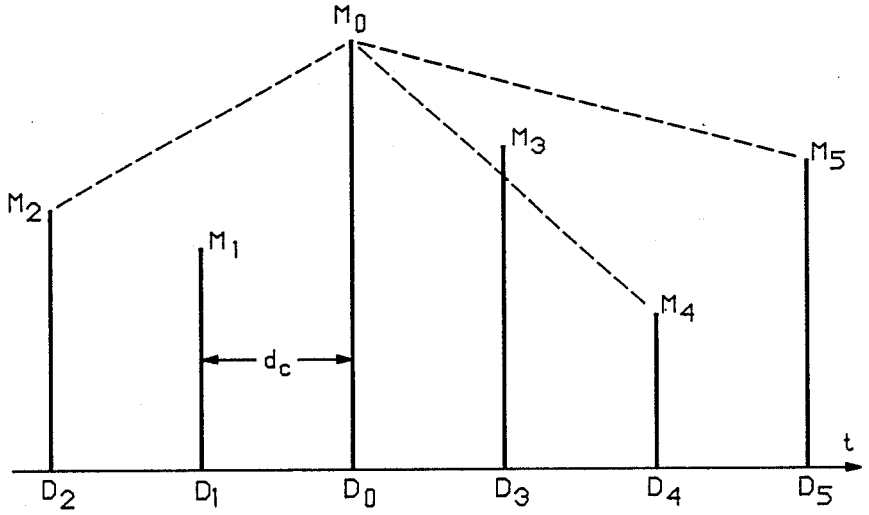
FIG. 4 illustrates, in graphic form, the candidate pulses of a speech frame.

Once pitch detector 302 has determined a subset of candidate pulses separated by a distance, $d_c \pm B$, an interpolation amplitude test is applied. The interpolation amplitude test performs linear interpolation between $M_0$ and each of the next adjacent candidate pulses, and requires that the amplitude of the candidate pulse immediately adjacent to $M_0$ is at least q percent of these interpolated values. Advantageously, the interpolation amplitude threshold, q percent, is 75%. Consider the example illustrated by the candidate pulses shown in FIG. 4. For $d_c$ to be a valid candidate distance, the following must be true:

$$M_1 > q\left[M_2 + \frac{M_0 - M_2}{|D_0 - D_2|}|D_1 - D_2|\right],$$

$$M_3 > q\left[M_4 + \frac{M_0 - M_4}{|D_0 - D_4|}|D_3 - D_4|\right],$$

and $$M_3 > q\left[M_5 + \frac{M_0 - M_5}{|D_0 - D_5|}|D_3 - D_5|\right],$$

where $$d_c = |D_0 - D_1| > 18.$$

As noted previously, $$M_i > gM_0, \text{ for } i = 1,2,3,4,5.$$

Pitch tracker 303 is responsive to the output of distance detector 302 to evaluate the pitch distance estimate which relates to the frequency of the pitch since the pitch distance represents the period of the pitch. Pitch tracker 303's function is to contrain the pitch distance estimates to be consistent from frame to frame by modifying, if necessary, any initial pitch distance estimates received from the pitch detector by performing four tests: voice segment start-up test, maximum breathing and pitch doubling test, limiting test, and abrupt change test. The first of these tests, the voice segment start-up test is performed to assure the pitch distance consistency at the start of a voiced region. Since this test is only concerned with the start of the voiced region, it assumes that the present frame has non-zero pitch period. The assumption is that the preceding frame and the present frame are the first and second voice frames in a voiced region. If the pitch distance estimate is designated by T(i) where i designates the present pitch distance estimate from distance detector 302, the pitch detector 303 outputs T*(i−2) since there is a delay of two frames through each detector. The test is only performed if T(i−3) and T(i−2) are zero or if T(i−3) and T(i−4) are zero while T(i−2) is non-zero, implying that frames i−2 and i−1 are the first and second voiced frames, respectively, in a voiced region. The voice segment start-up test performs two consistency tests: one for the first voiced frame, T(i−2), and the other for the second voiced frame, T(i−1). These two tests are performed during successive frames. The purpose of the voice segment test is to reduce the probability of defining the start-up of a voiced region when such a region is not actually begun. This is important since the only other consistency tests for the voice regions are performed in the maximum breathing and pitch doubling tests and there only one consistency condition is required. The first consistency test is performed to assure that the distance of the right most candidate sample in frame T(i−2) and the left most candidate sample in frame T(i−1) and the pitch distance T(i−2) are close to within a pitch threshold B+2.

If the first consistency test is met, then the second consistency test is performed during the next frame to ensure exactly the same result that the first consistency test ensured but now the frame sequence has been shifted by one to the right in the sequence of frames. If the second consistency test is not met, then T(i−1) is set to zero, implying that frame i−1 cannot be the second voiced frame (if T(i−2) was not set to zero). However, if both of the consistency tests are passed, then frames i−2 and i−1 define a start-up of a voiced region. If T(i−1) is set to zero, while T(i−2) was determined to be non-zero and T(i−3) is zero, which indicates that frame i−2 is voiced between two unvoiced frames, the abrupt change test takes care of this situation and this particular test is described later.

The maximum breathing and pitch doubling test assures pitch consistency over two adjacent voiced frames in a voiced region. Hence, this test is performed only if T(i−3), T(i−2), and T(i−1) are non-zero. The maximum breathing and pitch doubling tests also checks and corrects any pitch doubling errors made by the distance detector 302. The pitch doubling portion of the check checks if T(i−2) and T(i−1) are consistent or if T(i−2) is consistent with twice T(i−1), implying a pitch doubling error. This test first checks to see if the maximum breathing portion of the test is met, that is done by $$|T(i-2)-T(i-1)| \leqq A,$$

where A may advantageously have the value 10. If the above equation is met, then T(i−1) is a good estimate of the pitch distance and need not be modified. However, if the maximum breathing portion of the test fails, then the test must be performed to determine if the pitch doubling portion of the test is met. The first part of the test checks to see if T(i−2) and twice T(i−1) are close to within a pitch threshold as defined by the following, given that T(i−3) is non-zero, $$|T(i-2)-2T(i-1)| \leqq \frac{T(i-1)}{2}.$$

If the above condition is met, then T(i−1) is set equal to T(i−2). If the above condition is not met, the T(i−1) is set equal to zero. The second part of this portion of the test is performed if T(i−3) is equal to zero. If the following are met $$|T(i-2)-2T(i-1)| \leqq B$$

and $$|T(i-1)-T(i)| > A$$

then $$T(i-1)=T(i-2).$$

If the above conditions are not met, T(i−1) is set equal to zero.

The limiting test which is performed on T(i−1) assures that the pitch that has been calculated is within the range of human speech which is 50 Hz to 400 Hz. If the calculated pitch does not fall within this range, then T(i−1) is set equal to zero indicating that frame i−1 cannot be voiced with the calculated pitch.

The abrupt change test is performed after the three previous tests have been performed and is intended to determine that the other tests may have allowed a frame to be designated as voiced in the middle of an unvoiced region or unvoiced in the middle of a voiced region. Since humans usually cannot produce such sequences of speech frames, the abrupt change test assures that any voiced or unvoiced segments are at least two frames long by eliminating any sequence that is voiced-unvoiced-voiced or unvoiced-voiced-unvoiced. The abrupt change test consists of two separate procedures each designed to detect the two previously mentioned sequences. Once pitch tracker 303 has performed the previously described four tests, it outputs T*(i−2) to the pitch voter 151 of FIG. 1. Pitch tracker 303 retains the other pitch distances for calculation on the next received pitch distance from distance detector 302.

Figure 5:
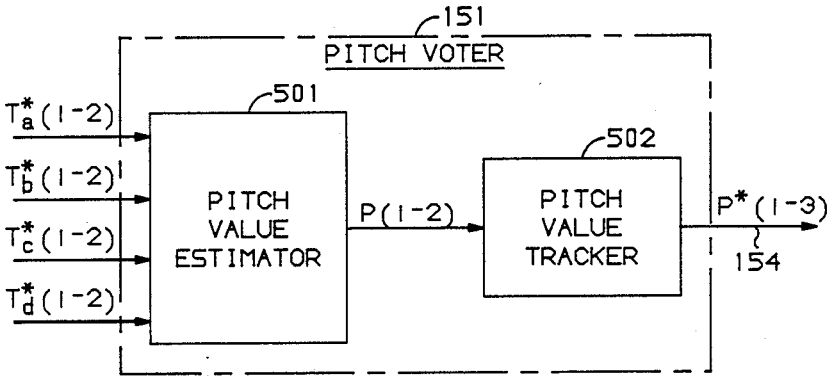
FIG. 5 illustrates, in block diagram form, pitch voter 151.

FIG. 5 illustrates in greater detail pitch voter 151 of FIG. 1. Pitch value estimator 501 is responsive to the outputs of pitch detectors 147 through 150 to make an initial estimate of what the pitch is for two frames earlier, P(i−2), and pitch value tracker 502 is responsive to the output of pitch value estimator 501 to constrain the final pitch value for the third previous frame, P(i−3), to be consistent from frame to frame.

Consider now, in greater detail, the functions performed by pitch value estimator 501. In general, if all of the four pitch distance estimates values received by pitch value estimator 501 are non-zero, indicating a voiced frame, then the lowest and highest estimates are discarded, and P(i−2) is set equal to the arithmetic average of the two remaining estimates. Similarly, if three of the pitch distance estimate values are non-zero, the highest and lowest estimates are discarded, and pitch value estimator 501 sets P(i−2) equal to the remaining non-zero estimate. If only two of the estimates are non-zero, pitch value estimator 501 sets P(i−2) equal to the arithmetic average of the two pitch distance estimated values only if the two values are close to within the pitch threshold A. If the two values are not close to within the pitch threshold A, then pitch value estimator 501 sets P(i=2) equal to zero. This determination indicates that frame i−2 is unvoiced, although some individual detectors determined, incorrectly, some periodicity. If only one of the four pitch distance estimate values is non-zero, pitch value estimator 501 sets P(i−2) equal to the non-zero value. In this case, it is left to pitch value tracker 502 to check the validity of this pitch distance estimate value so as to make it consistent with the previous pitch estimate. If all of the pitch distance estimate values are equal to zero, then, pitch value estimator 501 sets P(i−2) equal to zero.

Pitch value tracker 502 is now considered in greater detail. Pitch value tracker 502 is responsive to the output of pitch value estimator 501 to produce a pitch value estimate for the third previous frame, P*(i−3), and makes this estimate based on P(i−2) and P(i−4). The pitch value P*(i−3) is chosen so as to be consistent from frame to frame.

The first thing checked is a sequence of frames having the form: voiced-unvoiced-voiced, unvoiced-voiced-unvoiced, or voiced-voiced-unvoiced. If the first sequence occurs as is indicated by P(i−4) and P(i−2) being non-zero and P(i−3) is zero, then the final pitch value, P*(i−3), is set equal to the arithmetic average of P(i−4) and P(i−2) by pitch value tracker 502. If the second sequence occurs, then the final pitch value, P*(i−3), is set equal to zero. With respect to the third sequence, the latter pitch tracker is responsive to P(i−4) and P(i−3) being non-zero and P(i−2) being zero to set P*(i−3) to the arithmetic average of P(i−3) and P(i−4), as long as P(i−3) and P(i−4) are close to within the pitch threshold A. Pitch tracker 502 is responsive to $$|P(i-4)-P(i-3)| \leqq A,$$

to perform the following operation $$P^*(i-3) = \frac{P(i-4)+P(i-3)}{2}.$$

if pitch value tracker 502 determines that P(i−3) and P(i−4) do not meet the above condition (that is, they are not close to within the pitch threshold A), then, pitch value tracker 502 sets P*(i−3) equal to the value of P(i−4).

In addition to the previously described operations, pitch value tracker 502 also performs operations designed to smooth the pitch value estimates for certain types of voiced-voiced-voiced frame sequences. Three types of frame sequences occur where these smoothing operations are performed. The first sequence is when the following is true $$|P(i-4)-P(i-2)| \leqq A,$$

and $$|P(i-4)-P(i-3)| > A.$$

When the above conditions are true, pitch value tracker 502 performs a smoothing operation by setting $$P^*(i-3) = \frac{P(i-4)+P(i-2)}{2}.$$

The second set of conditions occurs when $$|P(i-4)-P(i-2)| > A,$$

and $$|P(i-4)-P(i-3)| \leqq A.$$

When this second set of conditions is true, pitch value tracker 502 sets $$P^*(i-3) = \frac{P(i-4)+P(i-3)}{2}.$$

The third and final set of conditions is defined as $$|P(i-4)-P(i-2)| > A,$$

and $$|P(i-4)-P(i-3)| > A.$$

For this final set of conditions occur, pitch value tracker 502 sets $$P^*(i-3)=P(i-4).$$

Further details concerning the operations of pitch detection circuit 130 are given in the copending U.S. patent application of J. Picone, et al., "A Parallel Processing Pitch Detector" Ser. No. 770,633, filed the same day as this application and assigned to the same assignee as this application. The copending U.S. patent application of J. Picone, et al., Ser. No. 770,631, is hereby incorporated by reference into this application.

It is to be understood that the above-described embodiment is merely illustrative of the principles of the invention and that other arrangements may be devised by those skilled in the art without departing from the spirit and scope of the invention.

What is claimed is:

1. A method for processing speech comprising the steps of:

partitioning the speech into successive time frames;

generating for each frame a set of speech parameter signals defining a vocal tract;

generating a voiced signal for each of said speech frames comprising voiced speech;

generating an unvoiced signal for each of said speech frames comprising unvoiced speech;

producing a coded excitation signal comprising pitch type excitation information for each of said speech frames designated as voiced by said voiced signal and other than pitch type excitation information for each of said speech frames designated as unvoiced by said unvoiced signal;

said step of producing said other than pitch type excitation information comprises the step of generating a sequence of pulses selected from pulses of a cross-correlation of an impulse response of said set of parameter signals and said speech for each frame; combining signals for each of said frames to form a coded combined signal representative of the speech for each of said frames.

2. The method of claim 1 wherein said step of generating said speech parameter signal set comprises the step of calculating a set of linear predictive parameters for each frame responsive to said speech of each frame.

3. The method of claim 1 wherein said partitioning step comprises the step of forming speech samples of said speech for each of said frames and said speech samples having positive and negative values and generating residual samples of said speech pattern for each of said frames and said residual samples having positive and negative values and said step of producing said pitch type excitation information comprises the steps of:

estimating a first pitch value for each of said frames in response to positive valued ones of said speech samples of each frame;

estimating a second pitch value for each of said frames in response to negative valued ones of said speech samples of each frame;

estimating a third pitch value for each of said frames in response to positive valued ones of said residual samples;

estimating a fourth pitch value for each of said frames in response to negative valued ones of said residual samples for each frame; and determining a final pitch value of a last previous speech frame in response to said estimated first, second, third, and fourth pitch values for said previous speech frame and pitch values for a plurality of previous speech frames and a present speech frame.

4. The method of claim 3 wherein said determining step comprises the steps of:

calculating a pitch value from said ones of said estimated first, second, third, and fourth pitch values; and constraining said final pitch value so that the calculated pitch value is in agreement with calculated pitch values from previous frames.

5. The method for processing speech of claim 1 further comprises the steps of:

generating a received voiced signal upon receipt of the combined coded signal having pitch type excitation information;

generating a received unvoiced signal upon receipt of said combined coded signal having said other than pitch noise type excitation information;

modeling said vocal tract in response to said set of speech parameter signals for each frame;

synthesizing each frame of speech utilizing said pitch excitation information upon said received voiced signal being generated; and synthesizing each frame of speech utilizing said other than pitch type excitation information upon generation of said received unvoiced signal.

6. A speech processing system for human speech comprising:

means for storing a plurality of speech frames each having a predetermined number of evenly spaced samples of instantaneous amplitude of said speech;

means for calculating a set of speech parameter signals defining a vocal tract for each speech frame;

means for generating a voiced signal for each of said speech frames comprising voiced speech;

means for generating an unvoiced signal for each of said speech frames comprising unvoiced speech;

means for producing a coded excitation signal comprising pitch type excitation information for each of said speech frames designated as voiced by said voiced signal and other than pitch type excitation information for each of said speech frames designated as unvoiced by said unvoiced signal;

said means for producing said other than pitch type excitation information comprises means for performing a cross-correlation operation of an impulse response of said set of parameter signals and said speech for each of said frames to produce cross-correlated pulse signals and means for selecting a sequence of pulses from said cross-correlated pulses as said other than pitch type excitation information; and means for combining said produced coded excitation signal and said set of said speech parameter signals for each of said frames to form a coded combined signal representative of the speech for each of said frames.

7. The system of claim 6 wherein said means for generating said set of speech parameter signals comprises means for calculating a set of linear predictive coded parameters for each of said frames.

8. The system of claim 6 wherein said means for producing said pitch type excitation information comprises:

each of a plurality of identical means responsive to an individual predetermined portion of said samples of each of said frames for individually estimating a pitch value for each of said frames; and means responsive to the individually estimated pitch values from each of said estimating means for determining a final pitch value for each of said frames.

9. The system of claim 8 wherein said determining means comprises:

means for constraining said final pitch value so that the calculated pitch value for each of said frames is in agreement with the calculated pitch values from previous ones of said frames.

10. The system of claim 6 further comprises means for receiving said coded combined signal;

means for generating a received voiced signal upon the received coded combined signal having pitch type excitation information;

means for generating a received unvoiced signal upon said received coded combined signal having said other than pitch type excitation information;

means for synthesizing each frame of speech utilizing said set of speech parameter signals and said pitch excitation information upon said received voiced signal being generated; and said synthesizing means further responsive to said set of speech parameter signals and said received unvoiced signal for utilizing said other than pitch type excitation information to synthesize each frame of speech.

* * * * *